US008926283B2

(12) United States Patent
Lee et al.

(10) Patent No.: US 8,926,283 B2
(45) Date of Patent: Jan. 6, 2015

(54) TURBINE BLADE ANGEL WING WITH PUMPING FEATURES

(71) Applicants: Ching-Pang Lee, Cincinnati, OH (US); Kok-Mun Tham, Oviedo, FL (US); Paul H. Vitt, Liberty Township, OH (US); Eric Schroeder, Loveland, OH (US)

(72) Inventors: Ching-Pang Lee, Cincinnati, OH (US); Kok-Mun Tham, Oviedo, FL (US); Paul H. Vitt, Liberty Township, OH (US); Eric Schroeder, Loveland, OH (US)

(73) Assignee: Siemens Aktiengesellschaft, München (DE)

( * ) Notice: Subject to any disclaimer, the term of this patent is extended or adjusted under 35 U.S.C. 154(b) by 70 days.

(21) Appl. No.: 13/688,411

(22) Filed: Nov. 29, 2012

(65) Prior Publication Data

US 2014/0147250 A1 May 29, 2014

(51) Int. Cl.

*F01D 11/00* (2006.01)
*F01D 5/14* (2006.01)
*F01D 11/02* (2006.01)

(52) U.S. Cl.

CPC ..... *F01D 5/141* (2013.01); *F01D 5/145* (2013.01); *F01D 11/001* (2013.01); *F01D 11/02* (2013.01)

USPC ..... 416/193 A; 415/168.4; 415/173.7

(58) Field of Classification Search

USPC ..... 415/116, 168.1, 168.2, 168.4, 173.1, 415/173.7, 174.3; 416/193 A

See application file for complete search history.

(56) References Cited

U.S. PATENT DOCUMENTS

| | | | | |
|---|---|---|---|---|
| 6,077,035 | A | 6/2000 | Walkers et al. | |
| 6,413,045 | B1 | 7/2002 | Dancer et al. | |
| 7,189,055 | B2 | 3/2007 | Marini et al. | |
| 7,189,056 | B2 | 3/2007 | Girgis et al. | |
| 7,244,104 | B2 | 7/2007 | Girgis et al. | |
| 7,320,574 | B2 | 1/2008 | Greim et al. | |
| 7,762,773 | B2 | 7/2010 | Liang | |
| 8,016,552 | B2 | 9/2011 | Bunker | |
| 8,083,475 | B2 | 12/2011 | Bulgrin et al. | |
| 2004/0265118 | A1* | 12/2004 | Naik et al. | 415/116 |
| 2006/0269399 | A1* | 11/2006 | Girgis et al. | 415/115 |
| 2009/0280011 | A1* | 11/2009 | Tibbott | 416/95 |
| 2010/0178159 | A1* | 7/2010 | Bulgrin et al. | 415/170.1 |
| 2011/0002777 | A1 | 1/2011 | Liang | |
| 2013/0272880 | A1 | 10/2013 | Boeck | |

FOREIGN PATENT DOCUMENTS

| | | |
|---|---|---|
| EP | 2586995 A2 | 5/2013 |

* cited by examiner

*Primary Examiner* — Igor Kershteyn
*Assistant Examiner* — Juan G Flores

(57) ABSTRACT

A gas turbine engine, including: a plurality of blades (60) assembled into an annular row of blades and partly defining a hot gas path (26) and a cooling fluid path (24), wherein the cooling fluid path extends from a rotor cavity (22) to the hot gas path; an angel wing assembly (99) disposed on a side (74) of a base (76) of the row of blades; and pumping features (130) distributed about the angel wing assembly configured to impart, at a narrowest gap (42) of the cooling fluid path, motion to a flow of cooling fluid flowing there through. The plurality of pumping features, the angel wing assembly, and the base of the row of blades are effective to produce a helical motion to the flow of cooling fluid as it enters the hot gas path.

18 Claims, 7 Drawing Sheets

TURBINE BLADE ANGEL WING WITH PUMPING FEATURES

FIELD OF THE INVENTION

The invention relates to improving an interaction of rotor cavity purge cooling air as it enters a flow of combustion gases. In particular, the invention relates to pumping features disposed in a turbine blade angel wing that impart a swirl to the flow of cooling air.

BACKGROUND OF THE INVENTION

Gas turbine engines conventionally include a rotor shaft and several rows of rotor blades, each row including multiple blades distributed circumferentially about the rotor shaft. In between the rows of blades are rows of stationary vanes. Combustion gases flow along the gas turbine engine longitudinal axis in an annular flow path defined by the blades and vanes. The rotor shaft lies radially inward of the annular flow path and a rotor cavity is formed between the rotor disk and a stator structure holding the stationary vanes. Cooling air, or rotor purge air is often directed into the rotor cavity. The purge air cools components within the rotor cavity that support the blades and vanes, after which the purge air typically exits the rotor cavity through a gap between the vanes and the blades on a radially inward end of the vanes and blades.

Combustion gases traveling in the annular flow path tend to form a "bow wave" immediately upstream of any components the gases encounter, such as a blade or vane. As a result, pressure builds up within the combustion gases immediately upstream of each blade. The bow waves are distributed circumferentially about the gas turbine engine, just radially outward of the gap. In order to prevent ingestion of the combustion gases into the gap and the rotor cavity, flow discouraging seals are often formed just inside the gap, slightly upstream of an outlet of the gap.

Flow discouraging seals may be formed via an angel wing, which uses a platform that extends axially from a base of the blade, together with a radially raised lip extending radially outward from a tip of the axial platform, to form a restriction in the gap intended to limit the flow of purge air outward, and combustion gases inward. The radially raised tip is conventionally axially aligned with an opposing surface, such as a surface on the stationary vane, which forms the restriction that acts as the flow discouraging seal.

It is known that the purge air has an aerodynamic impact on the flow of combustion gases where they interface, and various approaches have been taken to mitigate the impact. For example, U.S. Pat. No. 8,083,475 to Bulgrin et al. discloses an angel wing compression seal that guides the rotor air traversing the angel wing to a region in front of the respective blade. However, this patent appears to be limited to addressing the bow wave. Addressing other aerodynamic impacts, as well as addressing aerodynamic impacts for different blade geometries, leaves room in the art for improvement.

BRIEF DESCRIPTION OF THE DRAWINGS

The invention is explained in the following description in view of the drawings that show.

DETAILED DESCRIPTION OF THE INVENTION

The present inventors have recognized that the aerodynamic impact of the merging of rotor purge air with the combustion gases creates vortices. These vortices tend to traverse along the suction side of the blades, from front to back and from base to tip. This causes aerodynamic losses and an associated reduction in the energy that can be extracted from the combustion gases. During operation of the gas turbine engine the rotor blades are rotating about the gas turbine engine longitudinal axis. Prior to entering the combustion gas flow, the axially flowing rotor purge air is flowing at a negative angle of incidence with respect to a leading edge of a blade. The inventors have discovered that these vortices are formed, at least in part, due to axially flowing cooling air encountering combustion gases that are flowing helically about a gas turbine engine longitudinal axis, creating a large angle of encounter. In response, the inventors have developed pumping features integral to the angel wing that impart a swirl into the rotor purge air as the purge air traverses the angel wing. When the swirl is imparted to the axially traveling rotor purge air the rotor purge air ends up traveling in a helical manner about the gas turbine engine longitudinal axis. When the helically moving rotor purge air merges with the helically moving combustion gas at a smaller angle of encounter, the vortices are reduced. This, in turn, increases the efficiency with which the blade can extract energy from the combustion gases.

Figure 1:
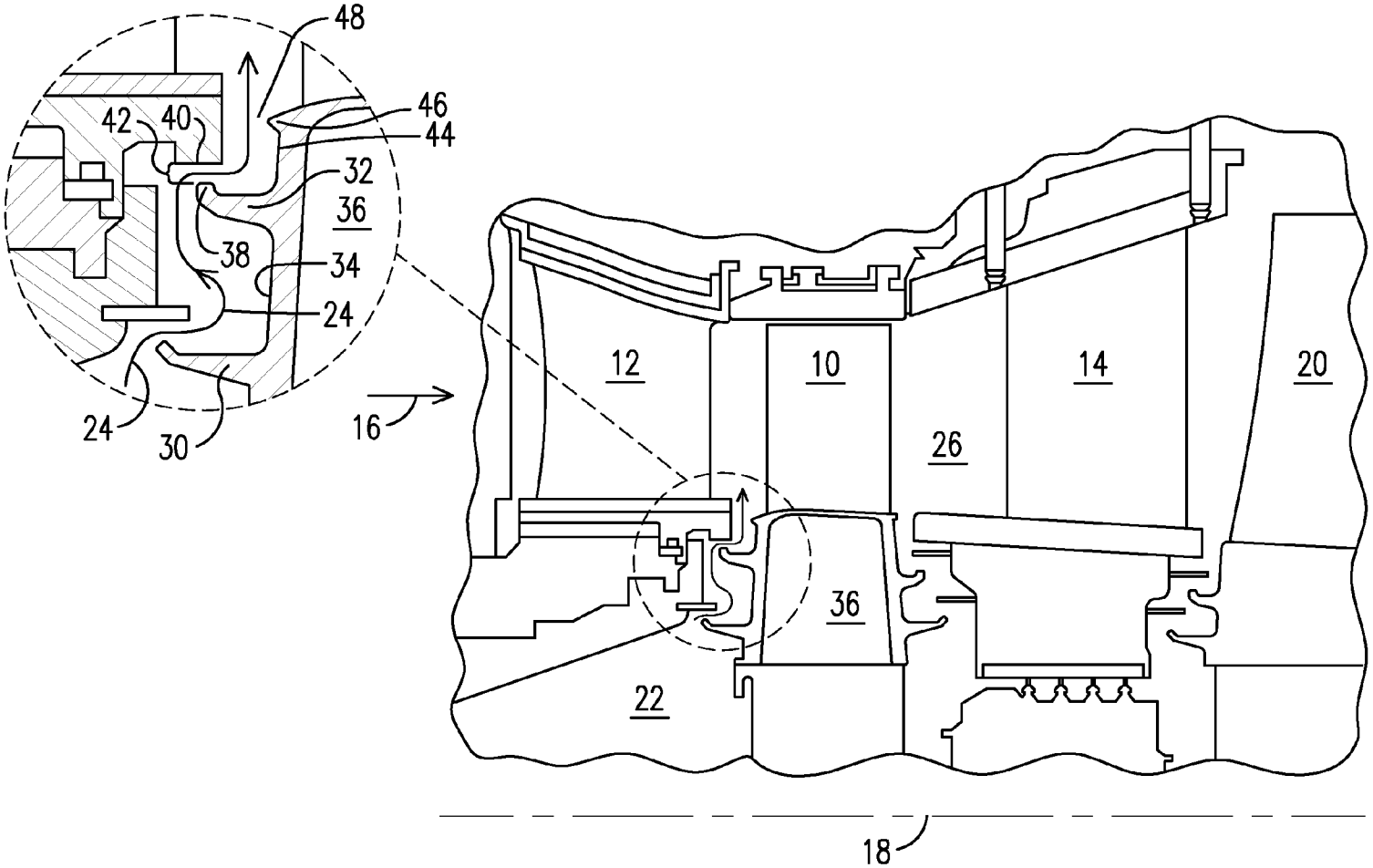
FIG. 1 is a schematic representation of a longitudinal cross section of a gas turbine engine showing one row of blades and adjacent vanes.

FIG. 1 shows a schematic representation of a longitudinal cross section of one configuration of a gas turbine engine showing one row of blades 10, upstream vanes 12, and downstream vanes 14, for which various pumping features have been developed. Combustion gas 16 flows through the upstream vanes 12 which direct the combustion gas 16 helically around a gas turbine engine longitudinal axis 18. The combustion gases encounter the blades 10, energy is extracted, and the combustion gas 16 then encounters the downstream vanes 14, which properly orient the combustion gas 16 for a subsequent row of blades 20. Some compressed air generated by a compressor (not shown) is redirected to a rotor cavity 22 where it follows a cooling fluid path 24 between the rotor cavity 22 and the combustion gas 16 in a hot gas path 26.

In the shown configuration there is a forward lower angel wing 30 and a forward upper angel wing 32 on an upstream side 34 of a base 36 of the blade 10. Each forward angel wing 30, 32 includes a radially raised lip 38. Radially outward of (i.e. axially opposite) the radially raised lip 38 of the forward upper angel wing 32 is an opposing surface 40, and the radially raised lip 38 and the opposing surface 40 together form a narrowed gap of the cooling fluid path 24 known as a flow discourager seal clearance 42. A vertical wall 44 and an overhang 46 are disposed proximate an outlet 48 of the cooling fluid path 24. Due to the vertical wall 44 and the overhang 46, even if the angle of encounter were previously recognized as causing a reduction in efficiency, it would have been impossible to impart any helical movement about the gas turbine engine longitudinal axis 18 to the rotor purge air as it merges with the combustion gas 16 because the vertical wall 44 and the overhang 46 would block any axial movement of the rotor purge air.

Figure 2:
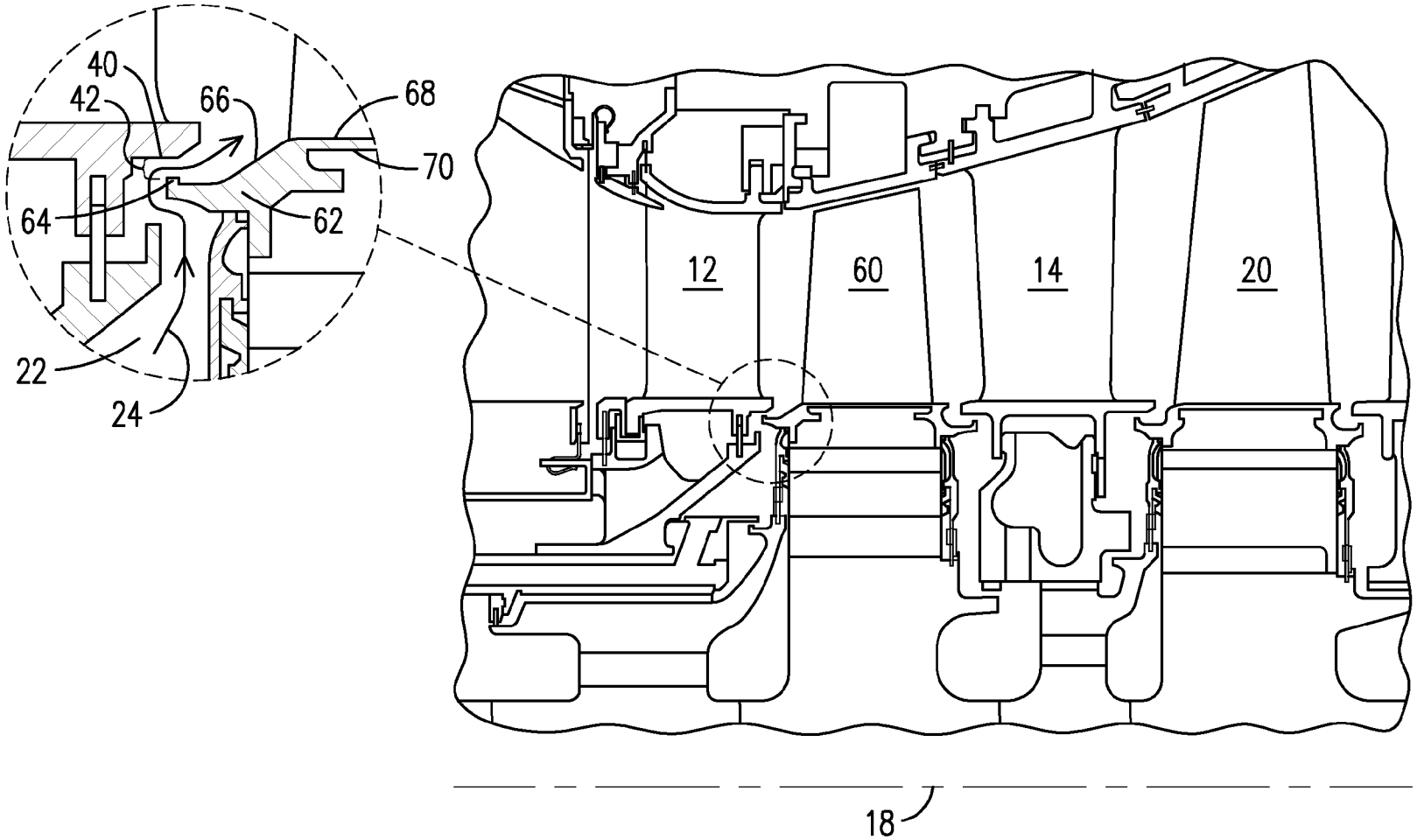
FIG. 2 is a schematic representation of a longitudinal cross section of a gas turbine engine of a different configuration than FIG. 1.

FIG. 2 is a schematic representation of a longitudinal cross section of a gas turbine engine of a different configuration than FIG. 1. In this configuration there exists a differently configured blade 60 with a differently configured, forward, upper angel wing 62, the rotor cavity 22, the cooling fluid path 24, a radially raised lip 64, the opposing surface 40, and the flow discourager seal clearance 42. However, instead of the vertical wall 44 and the overhang 46, in this embodiment the upper angel wing 62 has an angled transition surface 66 that blends into an upper surface 68 of a blade platform 70.

Figure 3:
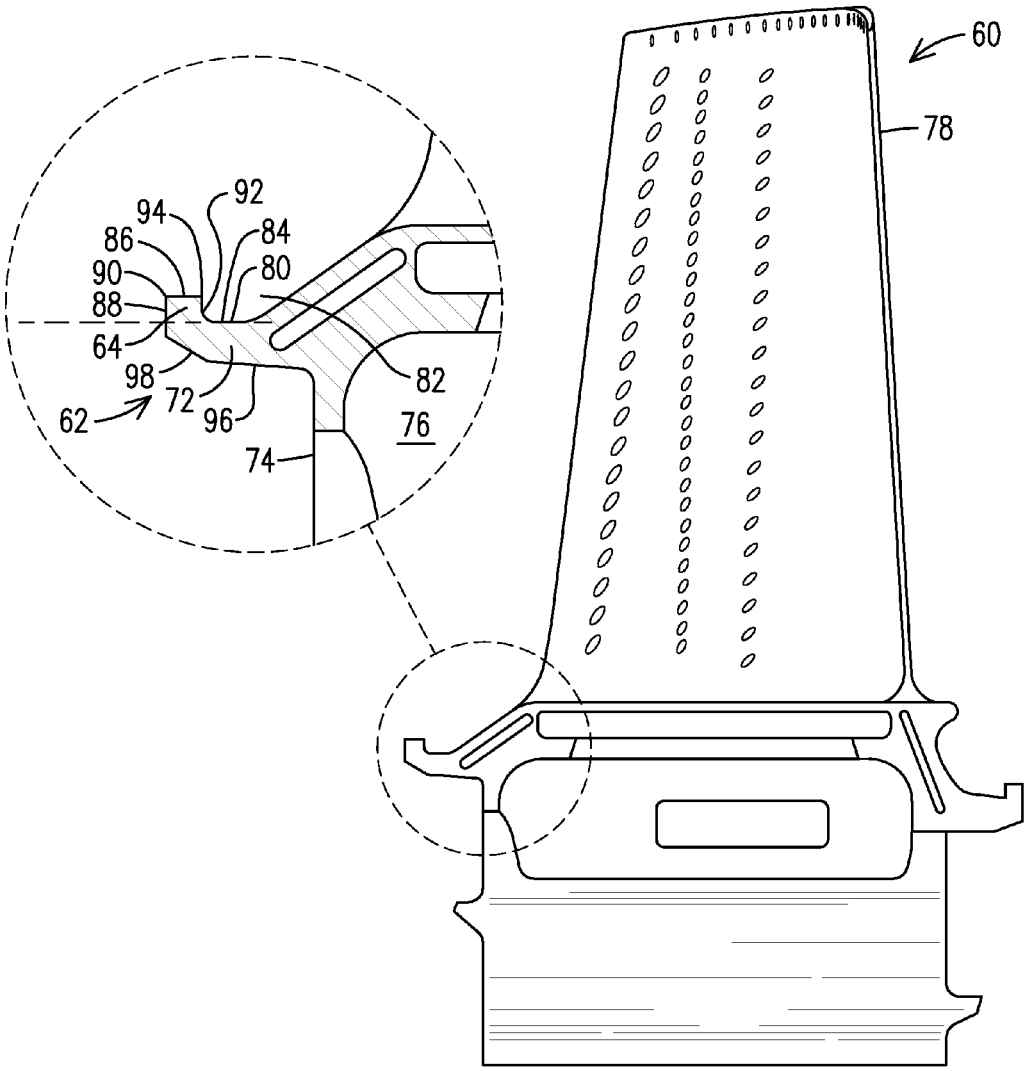
FIG. 3 is a blade with an angel wing.

FIG. 3 is a perspective view of the blade 60 that might be used in the gas turbine configuration of FIG. 2. The upper angel wing 62 has an axial platform 72 that extends axially from a vertical side surface 74 at a base 76 of the blade 60, the base 76 of the blade 60 being that part of the blade 60 not including an airfoil 78. The radially raised lip 64 extends radially outward with respect to the gas turbine engine longitudinal axis 18 from the axial platform 72 starting at a lowest level 80 of a valley 82 in a radially outer surface 84 of the angel wing 62, and ending at a sealing surface 86. At a relatively upstream end the sealing surface 86 intersects an upstream surface 88 of the axial platform 72 at an upstream corner 90 of the radially raised lip 64. At a relatively downstream end the sealing surface 86 intersects a downstream surface 92 of the radially raised lip 64 at a downstream corner 94 of the radially raised lip 64. The axial platform 72 has a radially inward side 96 that may or may not have a radially inward side upstream corner 98 that is chamfered.

Figure 4:
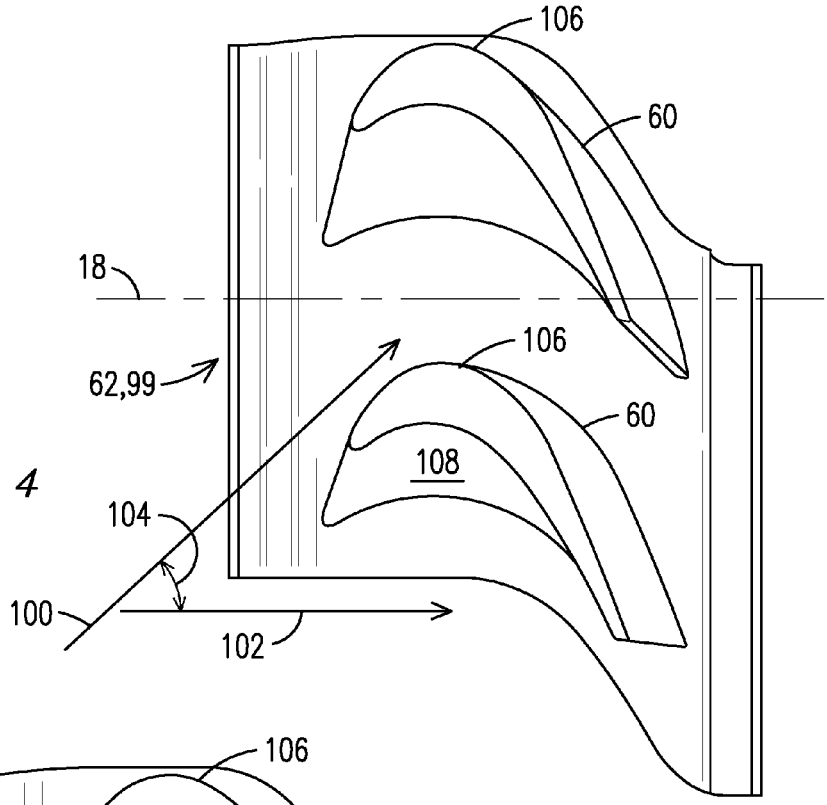
FIG. 4 shows assembled blades and a direction of an unguided flow of purge air.

FIG. 4 shows two assembled blades 60 as if assembled in a gas turbine engine, looking radially inward. The angel wings 62 are visible on an upstream side with respect to the gas turbine engine longitudinal axis 18 and form an angel wing assembly 99 when assembled in an annular row of blades 60. As the combustion gas leaves the upstream vanes 12 (not shown) it is traveling in a direction having both an axial component and a circumferential component, which in an annular flow passage, results in a helical flow direction 100. The rotor purge air flows radially outward with respect to the gas turbine engine longitudinal axis 18, and also flows axially along the angled transition surface 66 in an axial direction 102. A first angle of encounter 104 between the direction 100 of flow of combustion gas 16 and the direction 102 of flow of rotor purge air is when uninfluenced by any pumping features. The mixing of the combustion gas 16 and the rotor purge air forms vortices that tend toward a suction side 106 of the blade 60. Vortices may also flow past a pressure side 108 and merge with the suction side vortices across the platform toward the suction side of the adjacent airfoil and then roll upwardly along the suction side wall toward the upper section at the blade trailing edge.

Figure 5:
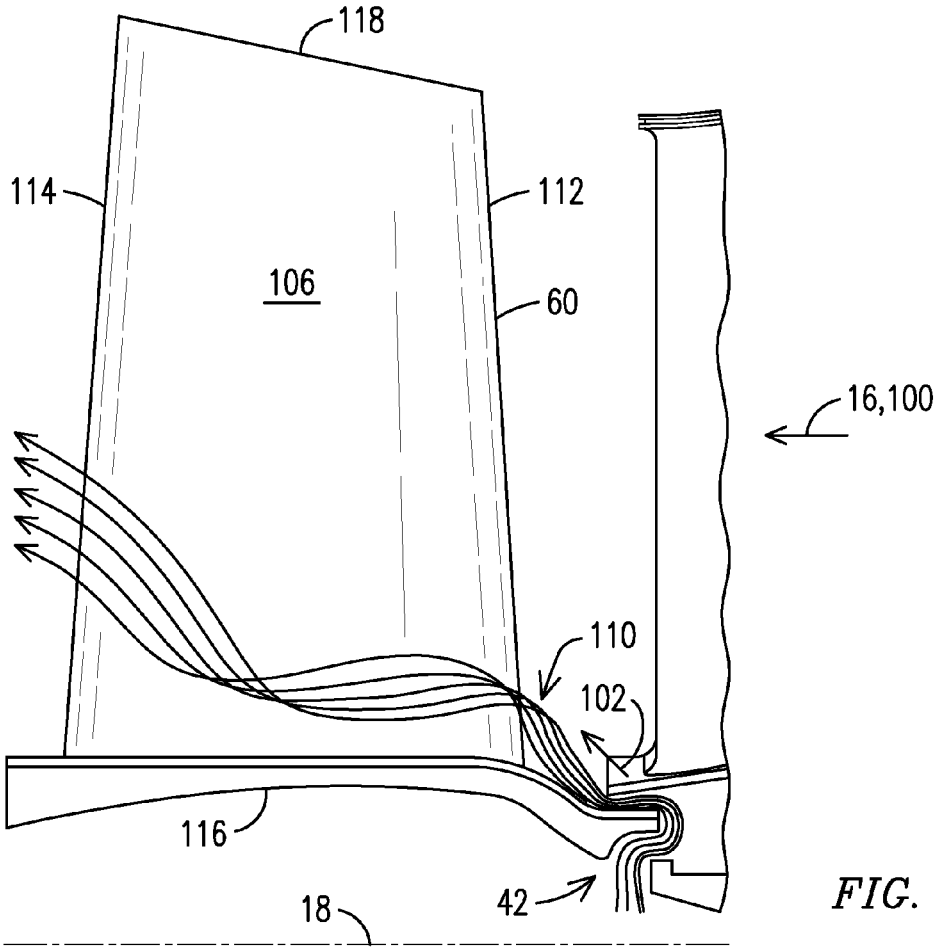
FIG. 5 shows streamlines of purge air and combustion gas mixing.

FIG. 5 shows a side view of a suction side 106 one of the blades 60 of FIG. 4. In this view the flow discourager 42 is on the right side, the combustion gas 16 is flowing from right to left in direction 100, and the rotor purge air is traveling radially and axially in direction 102. Where they meet streamlines 110 are formed, which travel from a blade leading edge 112 to a blade trailing edge 114, and from a blade base 116 to a blade tip 118, with respect to the gas turbine engine longitudinal axis 18. The turbulence of the vortices increases drag and as a result energy is lost due the drag slowing the flow. This reduces the operating efficiency of the engine.

Figure 6:
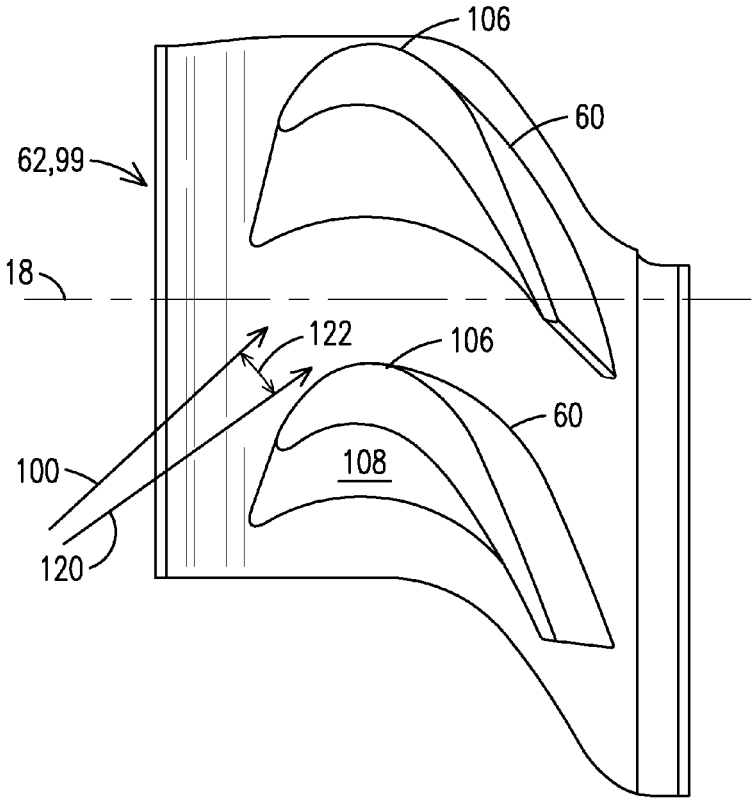
FIG. 6 shows assembled blades and a direction of a guided flow of purge air.

As can be seen in FIG. 6, the inventors has discovered that if a swirl is imparted to the rotor purge fluid so that it is moving in a helical direction 120 about the gas turbine engine longitudinal axis, then as it merges with the combustion gas 16, a second angle of encounter 122 between the direction 100 of flow of combustion gas 16 and the direction 120 of flow of rotor purge air results. Beneficially, this second angle of encounter 122 is smaller than the first angle of encounter 104. Consequently, the attendant vortices are smaller, the aerodynamic losses are smaller, and engine efficiency is increased.

Figure 7:
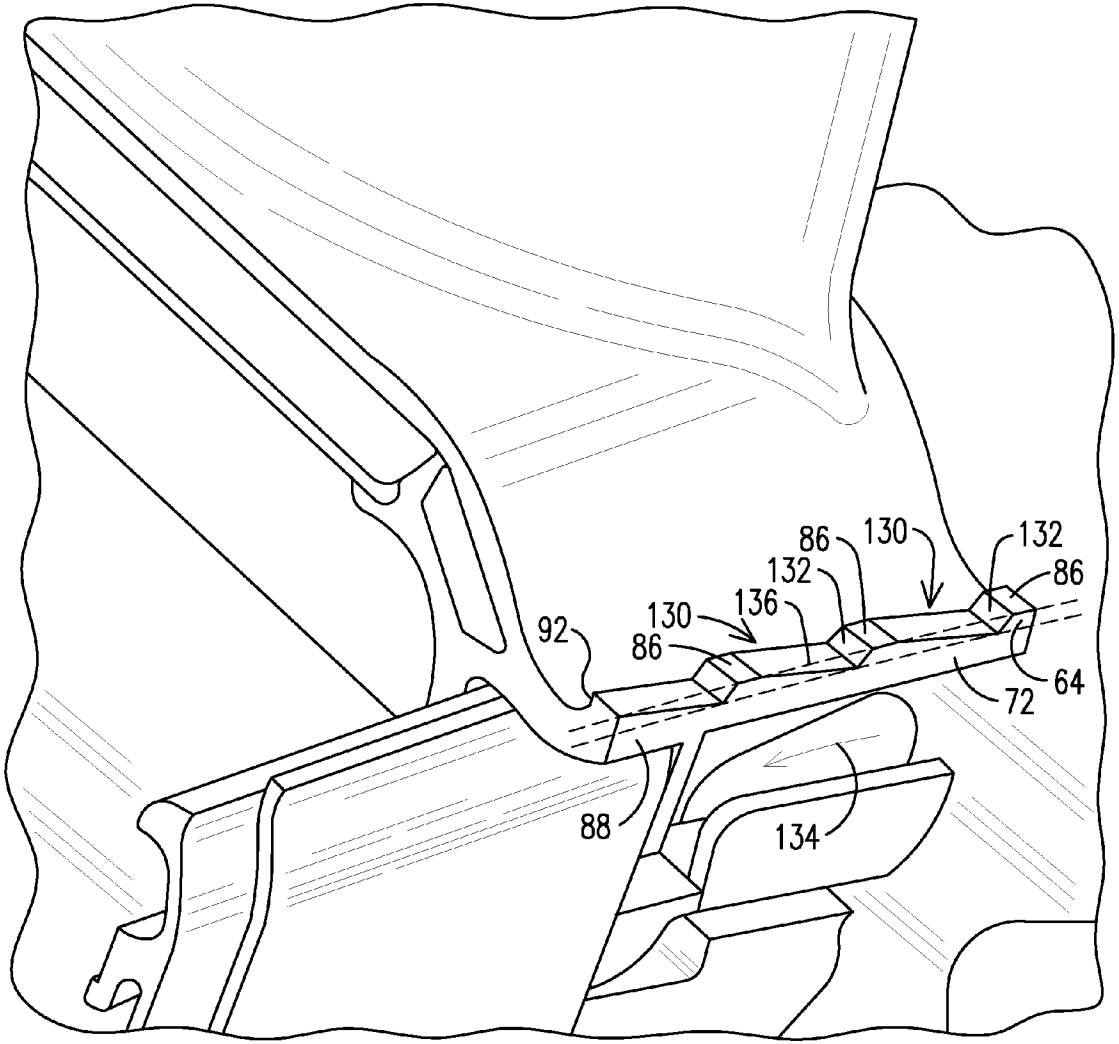
FIG. 7 shows an exemplary embodiment of the pumping features.

FIG. 7 shows an exemplary embodiment of the pumping features 130. In this embodiment the pumping features 130 include a first pumping surface 132 disposed on within the angel wing 62, and in particular, within the radially raised lip 64, between the upstream surface 88 of the axial platform 72 and the downstream surface 92 of the radially raised lip 64. The first pumping surface 132 may or may not extend radially inward into the axial platform 72. Disposed circumferentially between the first pumping surfaces 132 are discrete sealing surfaces 86, (as compared to a continuous sealing surface of constant diameter if the first pumping surfaces 132 were not present.) The first pumping surface 132 is oriented radially outward, and tangentially forward with respect to a direction of rotation 134 of the blade 60.

When assembled and rotating in the gas turbine engine, the angel wing 62 defines a sweep defined by space that axial platform 72 and the radially raised lip 64 occupy as they rotate. Given the rotation about the gas turbine engine longitudinal axis 18, the outer surfaces of the angel wing 62 define the sweep, and a cross section of the sweep, which has an annular shape, would resemble that a cross section of the angel wing 62 at the same location. For example, the sealing surfaces 86 define a sealing surface sweep 136 of a constant diameter. (The amount of curvature in the figure has been exaggerated for sake of explanation.) Thus the outer most surfaces define the shape of the sweep. As can be seen, the pumping features 130 are disposed entirely within the sweep defined by the angel wing 62, as evidenced by the example sealing surface sweep 136. Stated another way, no material is added to the angel wing 62 of FIG. 3 to create the pumping features 130. This is true for all embodiments disclosed herein and this provides for a unique advantage of the pumping features disclosed: every embodiment can be formed from existing blades 60 having angel wings 62, because each can be formed by the removal of material from the angel wing 62. Consequently, the pumping features 130 disclosed herein can be created as part of a retrofit process. Alternately, the pumping features 130 can be formed during the casting process when the angel wing is cast.

Due to its position within the flow discourager seal clearance 42, which is the narrowest gap in the cooling fluid path 24, the opposing surface 40 that also defines the flow discourager seal clearance 42 prevents the purge air from moving radially outward as it passes over the first pumping surfaces. Consequently, due to the unique configuration, instead of simply passing over the pumping features 130, the rotor purge is forced to rotate with the first pumping surface 132. This imparts the swirl into the rotor purge air which, together with the existing axial movement of the rotor purge air, produces the desired helical movement within the rotor purge air as it merges with the combustion gas 16. The annular flow of rotor fluid that is moving in a helical direction is also characterized by an essentially uniform circumferential distribution of pressure as it exits the cooling fluid path 24. As a result of the foregoing, the flow of rotor purge air tends to remain more attached to the blade platform 70, which reduces the amount of radial rise of the vortices. This, in turn, prevents the vortices from migrating toward the upper span of the suction side 106, which increases aerodynamic efficiency of the blade 60. Still further, more purge flow adheres to the blade platform 70, and the adhering purge flow also penetrates axially farther down the blade platform 70, allowing the blade platform 70 to remain cooler, thereby extending a service life of the blade 60. The performance has been demonstrated to be effective through computational fluid dynamic analysis.

Figure 8:
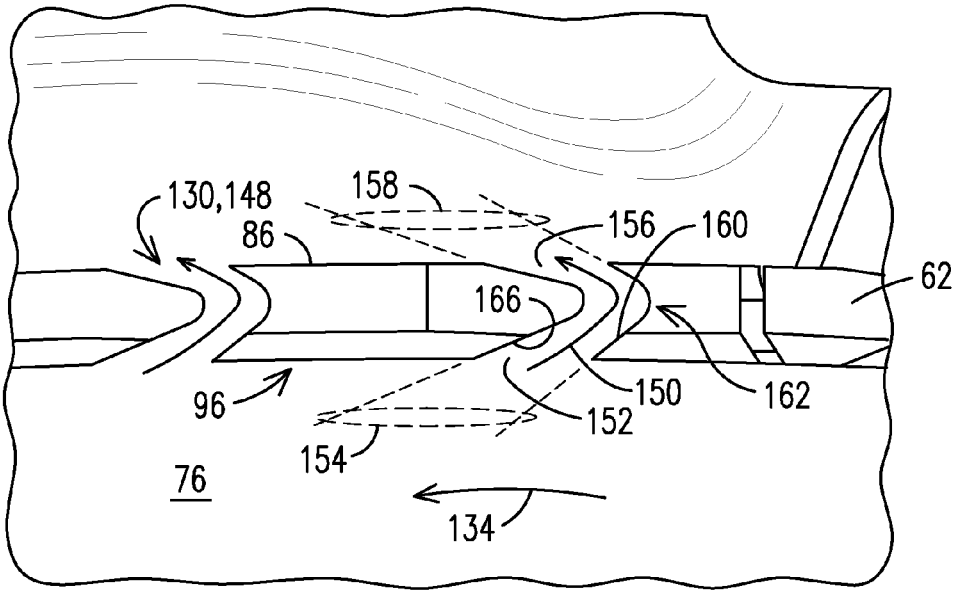
FIG. 8 shows a side view of an alternate exemplary embodiment of the pumping features.

FIG. 8 shows an alternate exemplary embodiment of the pumping features 130 as part of an angel wing assembly 99 at a base 76 of an annular row of blades 60. In this embodiment the pumping feature 130 resembles a scoop 148, with a concave shape. The scoop 148 defines a scoop flow path 150 having a scoop inlet end 152 disposed on the radially inward side 96 of the angel wing 62. The scoop inlet end 152 may act as a scoop in an exemplary embodiment where an extension 154 of the scoop extends radially inward and tangentially forward with respect to the direction of rotation 134 of the blade 60. The scoop flow path 150 also has a scoop outlet end 156 disposed at the sealing surface 86. An axial extension 158 of the scoop outlet end 156 extends radially outward and tangentially forward with respect to the direction of rotation 134 of the blade 60. The scoop flow path 150 includes a second pumping surface 160, and may further include a throat 162 that acts to accelerate rotor purge air flowing within the scoop flow path 150. The throat 162 may be disposed in the middle of the scoop flow path 150, or any other location as necessary. The scoop flow path 150 further includes a forward edge 166

In operation, a portion of the rotor purge air enters (i.e. is scooped into) the scoop flow path 150 where it is accelerated and where circumferential motion is imparted. The scooped rotor purge air is ejected radially outward and tangentially forward with respect to the direction of rotation 134, where it meets with rotor purge air that bypassed the scoop 148. The merging of the scooped rotor purge air with the rotor purge air that bypassed the scoop 148 causes the merged rotor purge flow to flow in a helical movement about the gas turbine engine longitudinal axis 18. As a result, when the merged rotor purge air merges with the combustion gas 16, the sought after smaller second angle of encounter 122 is effected.

Figure 9:
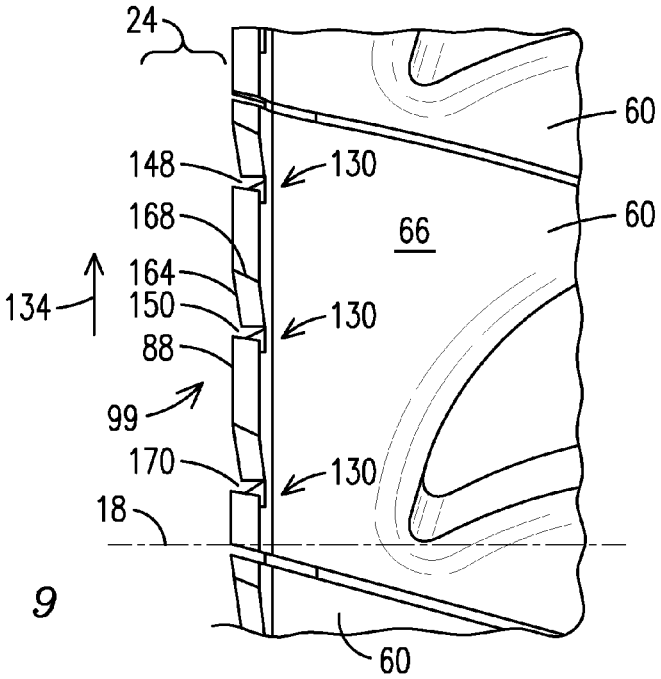
FIG. 9 shows a top view of the pumping features of FIG. 8.
Figure 10:
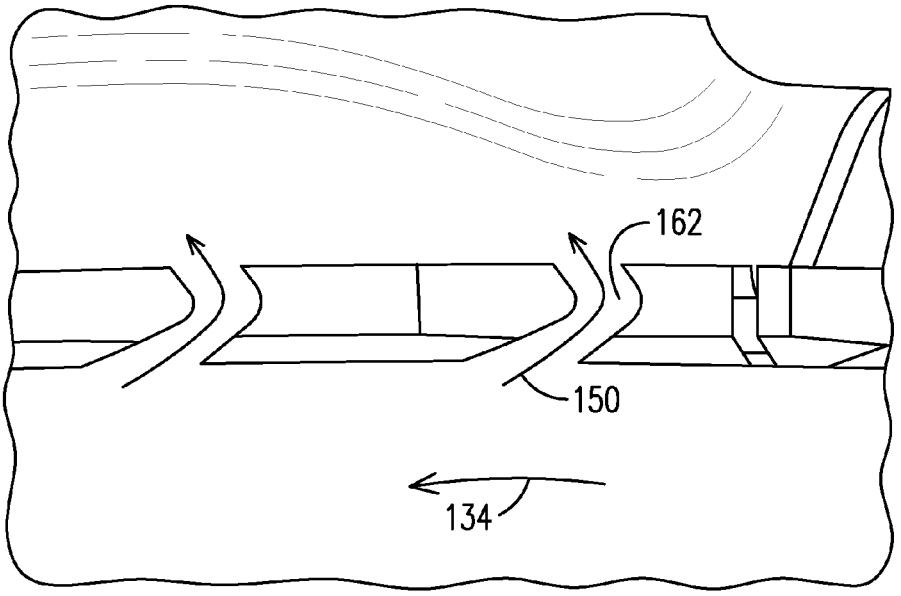
FIG. 10 shows another alternate exemplary embodiment of the pumping features.

FIG. 9 shows an optional feature for the scoop 148 of FIG. 8. In this view pumping features 130 of three blades 60 form a portion of the angel wing assembly 99 as viewed looking radially inward. On the upstream surface 88 of the axial platform 72 a scoop chamfer 164 may extend from a relatively upstream position 168 on the upstream surface 88 with respect to the direction of rotation 134 and taper downstream with respect to the gas turbine engine longitudinal axis 18 to end at the scoop flow path 150. In addition, an upstream side 170 of the scoop flow path 150 may not be enclosed, but may be open to the cooling fluid path 24. FIG. 10 shows an alternate exemplary embodiment of the scoop 148 of FIG. 8, where the throat 162 is disposed at an end of the scoop flow path 150.

Although the invention has been shown in two exemplary embodiments, any geometry capable of imparting the swirl as disclosed and within the sweep of the angel wing is considered within the scope of the disclosure. This includes orienting the first pumping surface 132 more tangentially forward facing, less tangentially forward facing, or completely tangentially forward facing. This further includes moving the scoop inlet end 152 to any position on the angel wing 62 suited for receiving rotor purge air, reconfiguring the scoop flow path 150 as necessary, and locating the scoop outlet end 156 to any position and orientation suitable for ejecting the scooped rotor purge air with a tangential component.

It has been disclosed that the inventors have found a simple and cost effective technique for inducing helical motion into rotor purge air prior to its merging with combustion gas. As a result, aerodynamic efficiency of the blade is improved, thereby increasing efficiency of the engine, and the blade platform is kept cooler, thereby increasing service life of the blade. Further, the pumping features disclosed herein can be incorporated into existing blades via a simple machining operation. In light of the foregoing, this represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine, comprising:

a plurality of blades assembled into an annular row of blades about a gas turbine engine longitudinal axis and partly defining both a hot gas path and a cooling fluid path, wherein the cooling fluid path extends from a rotor cavity, past a side of a radially inward base of the row of blades where the side is upstream with respect to a flow of hot gases in the hot gas path, and leads to the hot gas path;

an angel wing assembly disposed on the side of the base of the row of blades; and a plurality of pumping features, each comprising a single pumping surface and a complementary surface, distributed about the angel wing assembly configured to impart, at a narrowest gap of the cooling fluid path defined by the angel wing, motion to a flow of cooling fluid flowing there through, wherein the plurality of pumping features, the angel wing assembly, and the base of the row of blades are effective to produce a helical motion about the gas turbine engine longitudinal axis to the flow of cooling fluid as it enters the hot gas path, and wherein the single pumping surface and the complementary surface are disposed radially inward of and transverse to a radially outer surface of the angel wing assembly and circumferentially adjacent to each other.

2. The gas turbine engine of claim 1, wherein with respect to the gas turbine engine longitudinal axis the plurality of pumping features are integral to a portion of the angel wing assembly radially inward of and axially adjacent to an opposing surface, wherein the portion of the angel wing assembly and the opposing surface together define the narrowest swept gap in the cooling fluid path.

3. The gas turbine engine of claim 2, wherein the pumping surface faces radially outward and tangentially forward with respect to a direction of rotation of the row of blades during operation.

4. The gas turbine engine of claim 1, wherein each pumping feature defines a pumping feature flow path comprising an inlet facing radially inward with respect to the gas turbine engine longitudinal axis and forward with respect to a direction of rotation of the row of blades, and an outlet facing radially outward with respect to the gas turbine engine longitudinal axis and forward with respect to the direction of rotation of the row of blades.

5. The gas turbine engine of claim 4, wherein at least one pumping feature flow path further comprises a throat that defines a relatively narrow portion of the pumping feature flow path.

6. The gas turbine engine of claim 4, wherein the at least one pumping feature flow path is unbounded at an axial upstream end with respect to the gas turbine engine longitudinal axis.

7. The gas turbine engine of claim 6, the angel wing assembly further comprising a chamfer between each pumping feature flow path, wherein each chamfer tapers into a respective pumping feature flow path.

8. A gas turbine engine blade, comprising:

a blade base;

an angel wing formed in a side of the blade base, the angel wing comprising an axial platform; and a plurality of pumping features, each comprising a single pumping surface, wherein the pumping surface is disposed entirely within a circumferential sweep of the angel wing.

9. The gas turbine engine of claim 8, wherein when assembled in the gas turbine engine and with respect to a gas turbine engine longitudinal axis the pumping features are disposed radially inward of and axially aligned with an opposing surface, and the pumping features and the opposing surface define a flow discouraging seal clearance in a cooling fluid path.

10. The gas turbine engine of claim 9, wherein when assembled in the gas turbine engine each pumping surface faces radially outward with respect to the gas turbine engine longitudinal axis and tangentially forward with respect to a direction of rotation of the assembled annular row of blades.

11. The gas turbine engine of claim 8, wherein when assembled in the gas turbine engine each pumping feature comprises a pumping feature flow path spanning the angel wing assembly from a radially inward facing surface to a radially outward facing surface with respect to the gas turbine engine longitudinal axis.

12. The gas turbine engine of claim 11, wherein the pumping feature flow path comprises a concave shape.

13. The gas turbine engine of claim 12, wherein a radially inward end of the pumping feature flow path is an inlet end effective to scoop at least a portion of the flow of cooling fluid flowing, and wherein a radially outward end of the pumping feature flow path is an outlet end effective to eject the scooped cooling fluid both radially outward with respect to the gas turbine engine longitudinal axis and in a direction of rotation of the row of rotating blades, thereby reuniting the scooped cooling fluid with an unscooped portion of the flow of cooling fluid bypassing the pumping features.

14. The gas turbine engine of claim 12, wherein with respect to the gas turbine engine longitudinal axis the pumping feature flow path is open on an upstream side, and wherein the angel wing further comprises a chamfer originating with respect to a direction of rotation of the row of blades upstream of the pumping feature open side and ending at the pumping feature flow path.

15. A gas turbine engine blade, comprising:

a blade base; and an angel wing formed in a side of the blade base that is upstream with respect to hot gases flowing past the blade in a hot gas path in a gas turbine engine during operation, the angel wing comprising: an axial platform; a radially raised lip comprising a surface that faces downstream with respect to a direction of rotation of the gas turbine engine blade; and a pumping feature defining a pumping flow path comprising an outlet terminus axially adjacent or upstream of a downstream edge of the radially raised lip with respect to the gas turbine longitudinal axis, wherein the pumping feature comprises a single pumping surface and a complementary surface, both of which recess radially inward from a radially outer surface of the radially raised lip and also define the pumping flow path there between.

16. The gas turbine engine blade of claim 15, wherein the pumping surface is oriented radially outward with respect to the gas turbine engine longitudinal axis, tangentially forward with respect to a direction of rotation of the gas turbine engine blade, and recessed between sealing surfaces of the radially raised lip disposed farthest from the gas turbine engine longitudinal axis.

17. The gas turbine engine blade of claim 15, wherein each pumping feature comprises an inlet on a radially inward facing surface of the axial platform, an outlet on a radially outward facing surface side of the radially raised lip, and a pumping feature flow path through the angel wing.

18. The gas turbine engine blade of claim 17, wherein the pumping feature is effective to eject the cooling fluid tangentially forward with respect to a direction of rotation of the gas turbine engine blade.

* * * * *